US005647541A

United States Patent [19]

Nelson

[11] Patent Number: 5,647,541

[45] Date of Patent: Jul. 15, 1997

[54] WATER FLOW CONTROL DEVICE FOR ROTARY SPRINKLER

[76] Inventor: Michael C. Nelson, 1876 Del Amo Blvd. Unit A, Torrance, Calif. 90501-1301

[21] Appl. No.: 431,014

[22] Filed: Apr. 28, 1995

[51] Int. Cl.[6] ..... B05B 3/00

[52] U.S. Cl. ..... 239/590.5; 239/DIG. 1; 239/230

[58] Field of Search ..... 239/97, DIG. 1, 239/230–233, 590, 590.5; 137/624.13, 624.14

[56] References Cited

U.S. PATENT DOCUMENTS

| | | | |
|---|---|---|---|
| 2,780,488 | 2/1957 | Kennedy | 299/18 |
| 3,884,416 | 5/1975 | King | 239/97 |
| 4,180,210 | 12/1979 | DeWitt | 239/97 |
| 4,277,029 | 7/1981 | Rabitsch | 239/232 |
| 4,462,545 | 7/1984 | Lourenco | 239/97 |
| 4,819,875 | 4/1989 | Beal | 239/97 |

*Primary Examiner*—Robert J. Oberleitner

*Assistant Examiner*—C. T. Bartz

*Attorney, Agent, or Firm*—Richard C. Litman

[57] ABSTRACT

A fluid flow regulator readily attachable between a rotary sprinkler and a fluid conduit for regulating the water flow and pressure to the sprinkler to irrigate an irregular pattern such as a square. The regulator icludes a body having a streamlined channel leading to a straight through flow variable orifice and being connectable with a respective fluid port member of the sprinkler and the conduit. A rotatable port piece mounted in the body has a straight through flow port, centered on the axis of rotation and communicating with the straight through flow orifice of the body. This port leads to a streamlined channel which exits into the sprinkler shaft. The port piece has a means for coupling rotational energy from the sprinkler. The port and orifice have an identical design such as a four point star or equilateral concaved octagon adapted for watering in a square pattern. The rotational position of the port piece in relation to the body regulates the flow of water. A retaining sleeve, mounted in the body, accomodates a washer and the port piece holding them in place and allowing them to rotate.

11 Claims, 4 Drawing Sheets

WATER FLOW CONTROL DEVICE FOR ROTARY SPRINKLER

BACKGROUND

1. Field of Invention

The present invention relates to devices for distributing irrigation water to crops, lawn areas, and the like. It relates, more particularly, to such devices equipped with rotating sprinkler heads.

2. Description of Prior Art

It is known in the prior art to provide a water distributing device based on a rotary sprinkler head whose rotation is derived from the internal energy of the pressurized water passing therethrough. Most of these devices of the prior art are restricted, inherently, to a distribution pattern corresponding to a circle whose center is the location of the sprinkler head and whose radius corresponds to the reach of the jet, or jets, issuing from its orifices. However, use of such devices may necessitate the over-lapping of sprinkled areas and the precipitation of undesired areas in order to irrigate a non-circular shaped area.

There have also been proposed variations on these devices which would permit the shape of the irrigated area to be varied from a circular one, typically to a square or rectangle, and even an arbitrary pattern.

Such devices have not met with commerical success due to their poor performance, high cost, unreliable operation, or a combination of such factors.

A prior art device described in U.S. Pat. No. 3,884,416 issued May 20, 1975 to Michael L. King appears to produce a desired irrigation pattern by means of an orifice plate having rectangular passages and a port plate having rectangular ports. The radial reach of the water is varied depending upon the mutual overlap between the radially offset ports. The primary disadvantage of this approach lies in the small port size required to vary the water flow. Small holes tend to get plugged up with particles, thereby requiring frequent disassembly and cleaning. Another disadvantage is in the requirement of an adjustable device for obtaining a constant angular velocity. This adjustment has to be made for each change in water pressure.

Another prior art device described in U.S. Pat. No. 4,819,875 issued Apr. 11, 1989 to Glenn I. Beal appears to produce an irregular watering pattern by means of a throttling device for controlling water flow to the sprinkler in accordance with the rotary position of the sprinkler relative to the housing. No attempt was made to control the angular velocity of the sprinkler to a constant.

Both of the above prior art allow the water supply pressure to force the rotating sprinkler against its washers creating a large rotating frictional force. This force is greater when the flow is restricted due to the increased back pressure. This makes it nearly impossible to achieve a constant angular velocity with conventional impact sprinklers.

All the devices heretofore known suffer from a number of disadvantages:

(a) A complicated device makes it expensive to manufacture.

(b) If water flow is not straight through, unreliable operation occurs from small holes getting plugged, which requires disassembly and cleaning.

(c) Angular velocity is not constant creating a non-uniform water distribution.

(d) Standard impact sprinklers would need to be modified to achieve the desired results.

Objects and Advantages

In contrast to the prior art, the present invention provides a fluid flow regulator attachment for a rotary sprinkler which utilizes a straight through flow variable orifice defined by a unique pattern. It also provides for a self-adjusting constant angular velocity for uniform water distribution over a wide range of water pressure. It also provides for simplified manufacturing and construction.

Accordingly, several objects and advantages of the present invention are:

(a) to provide apparatus for regulating fluid flow through a variable orifice of straight through design.

(b) to provide in such a device constructional features allowing constant angular velocity over a wide range of water pressure to achieve uniform distribution.

(c) to provide in such a device constructional features leading to reliable operation and ease of maintenance.

(d) to provide in such a device constructional features leading to the lowest possible manufacturing costs.

(e) to provide a design by which any standard rotary sprinkler can be made to distribute water in an irregular pattern.

Further objects and advantages of the present invention will become apparent from a consideration of the drawings and ensuing description.

DRAWING FIGURES

REFERENCE NUMERALS IN DRAWINGS

| | |
|---|---|
| 10 regulator | 11 body |
| 12 rotatable port piece | 13 retaining sleeve |
| 14 washer | 15 cylindrical surface |
| 16 threads | 17 threads |
| 18 wrench flats (hex) | 19 bore |
| 20 bore | 21 ledge |
| 22 streamlined channel | 23 orifice |
| 24 orifice pattern | 25 orifice face |
| 26 channel | 27 port |
| 28 port pattern | 29 port face |
| 30 shaft | 31 connecting ears |
| 32 channel | 33 streamlined channel |
| 34 port piece end | 35 face |
| 36 bore | 37 surface or face |
| 38 retaining sleeve wall | 39 bore |
| 40 face | 41 face |
| 42 washer wall | 45 overlap area |
| 50 rotating sprinkler head | 51 shaft |
| 52 connector | 53 nozzle |
| 54 arm | 55 spring |
| 56 washer | 57 bore |
| 58 frame member | |

DESCRIPTION OF THE PREFERRED EMBODIMENT

Figure 1:
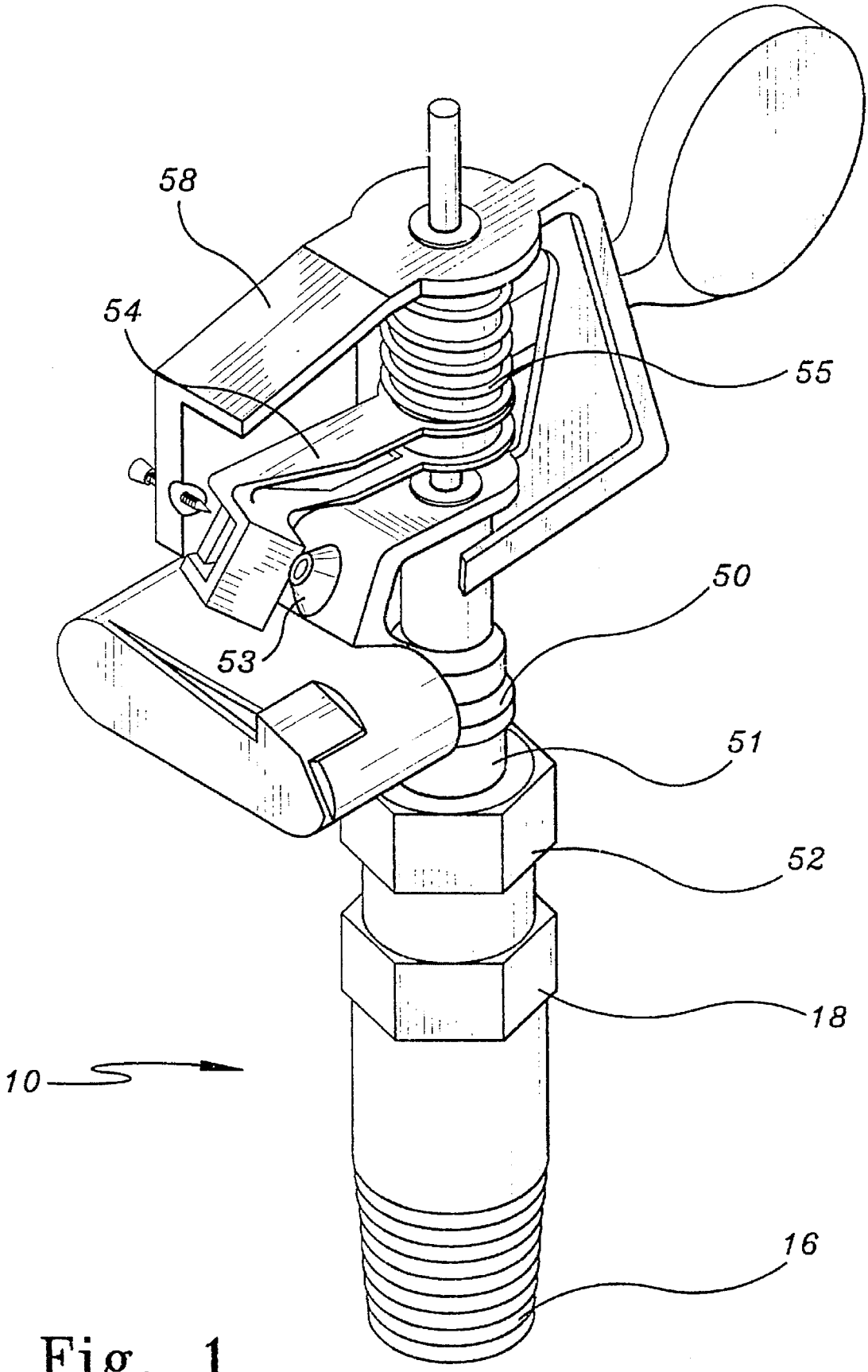
FIG. 1 is a side view of a device for the distribution of irrigation water.
Figure 2:
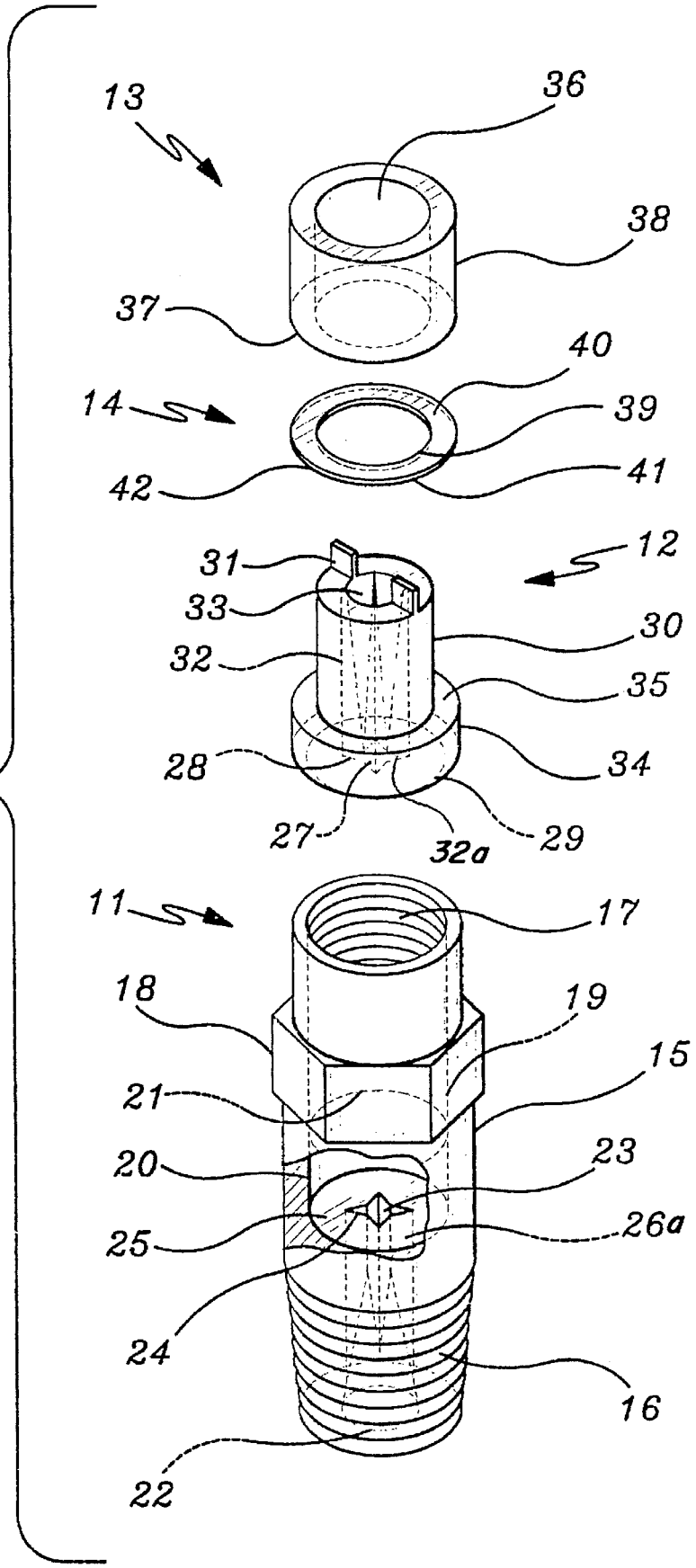
FIG. 2 is an exploded view of the preferred embodiment of the present invention.
Figure 3:
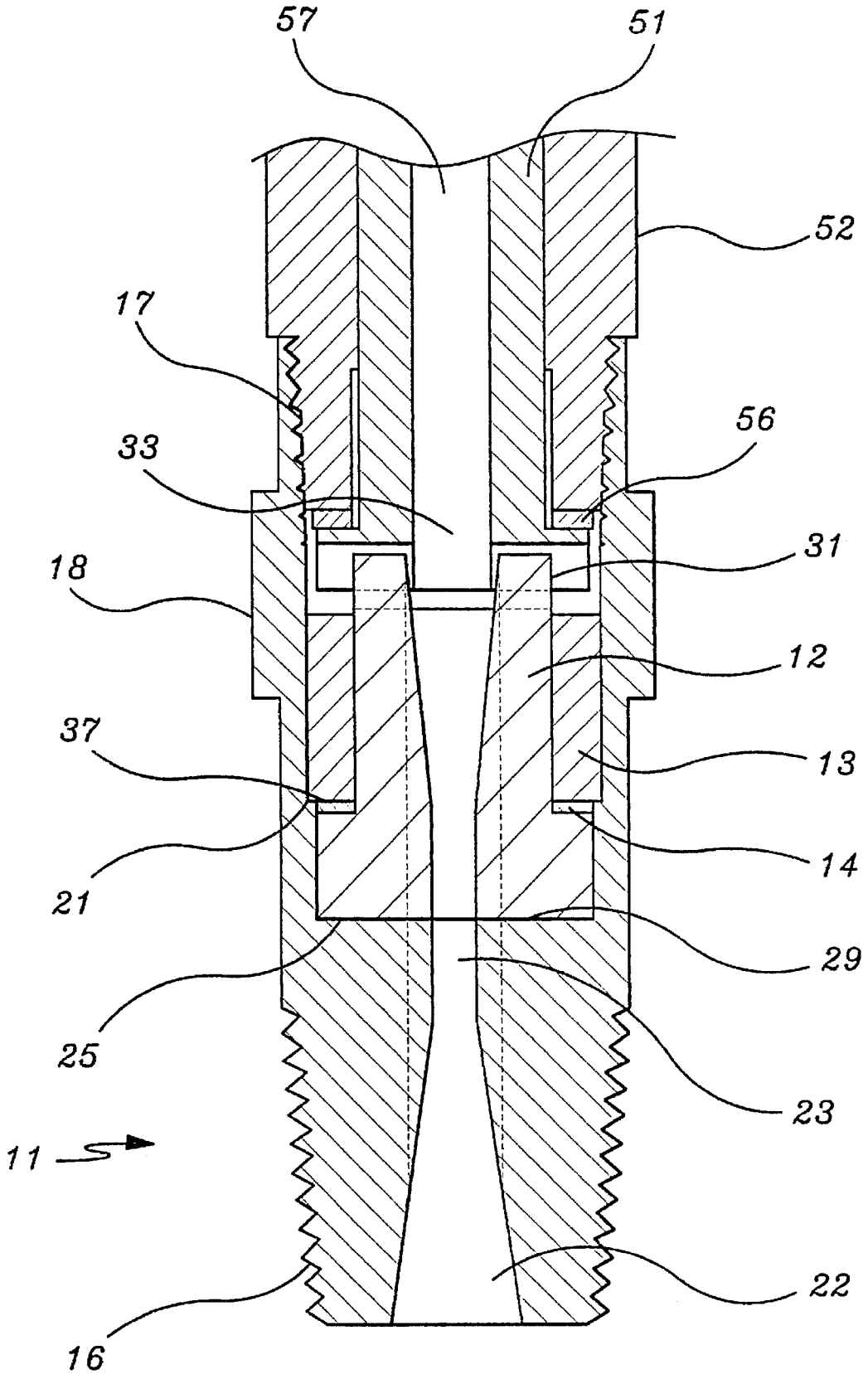
FIG. 3 is a vertical section of the preferred embodiment of the present invention.

Referring to the drawings, particularly FIGS. 1–3, there is shown an irrigation pattern adaptor or fluid flow regulator 10 constructed in accordance with the invention to have a simple water flow/pressure regulator valve generally comprising a body or water channel section 11, a rotatable port piece 12, a retaining sleeve 13, and a washer 14. The constituent parts of the adaptor may be formed, for example, of any suitable metal, ceramic, or plastic or combination thereof.

The water channel 11 comprises a generally cylindrical column or tubular member having a cylindrical surface 15. The upper and lower ends of the water channel 11 have internal and external pipe threads 16 and 17 respectively to permit the water channel 11 to be connected to a rotating sprinkler head 50 and a water conduit, respectively, such as a riser pipe (not shown). Integral wrench flats 18 may be provided to facilitate connecting the threaded female end of the conduit to the lower threaded male end of the water channel 11.

The upper end of the water channel 11 is provided with internal bores 19 and 20 adapted to receive port piece 12, retaining sleeve 13 and washer 14. The diameter of internal bore 20 is larger than the outside diameter of an enlarged port piece end 34 and a washer wall 42, and allows for the free rotation of port piece 12 and washer 14. The diameter of bore 19 accomodates a retaining sleeve wall 38 with a press fit. Other suitable means for securing retaining sleeve 13 could be employed such as threads. The retaining sleeve 13 is pressed into bore 19. A sleeve face 37 is brought into contact with a ledge 21 of water channel 11.

The lower end of the water channel 11 is comprised of a streamlined channel 22 leading to an orifice 23. Tapered protrusions 26*a* extend longitudinally along streamlined channel 22 from an orifice 23 to an entrance of streamline channel 22. Protrusions 26*a* are ideally tapered at an angle of approximately 8 degrees. Protrusions 26*a* form an orifice pattern 24 in an orifice face 25.

The rotatable port piece 12 has an enlarged end 34 and a shaft 30 with connecting ears 31. The outside diameter of shaft 30 is smaller than the internal bores 36 and 39 of retaining sleeve 13 and washer 14, respectively, allowing the free rotation of port piece 12. A streamlined channel 33 passes through port piece 12 from a port face 29 to an enlarged end 34. Tapered projections 32*a* extend into channel 33 from port 27. Projections 32*a* are ideally tapered at an angle of approximately 8 degrees. Projections 32*a* form a port pattern 28 in port face 29. Connecting ears 31 appear on the end of shaft 30 and make a coupling to a rotary sprinkler shaft 51. Other configurations suitable for coupling port piece 12 to rotary sprinkler shaft 51 may be used.

Retaining sleeve 13 facilitates securing the location of rotatable port piece 12 in body 11. An enlarged end face 35 engages a lower washer face 41. An upper washer face 40 engages retaining sleeve face 37. Retaining sleeve 13 is urged into location gently, securing washer 14 and port piece 12 in body 11. Port face 29 and an orifice face 25 are in intimate contact with one another. Port piece 12 is able to rotate with no axial play.

Fluid flow regulator 10 is readily connected to a male connector 52 of rotary sprinkler head 50 by means of threads 17.

Rotary sprinkler head 50 has a jet or nozzle 53 for distributing the water entering the internal passages of the head through bore 57 of shaft 51. Shaft 51 rotates against a washer 56, which rests against the connector 52. As water under pressure is jetted from nozzle 53 it impacts a cantilevered arm 54 deflecting it away from a frame member 58 and, thereby, winding up a spring 55. The spring tension so generated urges arm 54 toward frame member 58, where the water jet pushes the arm outwardly again. This oscillating motion is indefinitely repeated whereby the water jet pressure is utilized to provide rotary motion to the sprinkler head.

Rotary sprinkler head 50 is of conventional design similiar to prior art impact driven sprinklers whose irrigation pattern is a circle, delimited by the radius to which water is delivered from nozzle 53. Sprinklers of this type can have a selectively operable reversing mechanism permiting either a part circle or full circle operation.

Operation

With fluid flow regulator 10 connected to rotary sprinkler head 50 (shown in FIG. 1) and vertically supported by conventional means (not shown), the water flows upwardly under pressure from the conduit (not shown) into the entrance of streamlined channel 22. The water continues to flow upwardly through orifice 23 and port 27 into streamlined channel 33, through bore 57 into sprinkler head 50, where it is jetted from nozzle 53. As noted above, the water jet causes sprinkler head 50 to rotate, which results in the rotation of port piece 12.

The hydraulic pressure at the entrance of streamlined channel 22 causes water to flow through channel 22 into orifice pattern 24. As streamlined channel 22 constricts, the water is forced to accelerate in velocity as it enters orifice pattern 24. Channels 26, formed between projections 26*a*, act as flow straightners ensuring a smooth transition to orifice 23. The higher water velocity determines a lower pressure at orifice 23.

Figure 4:
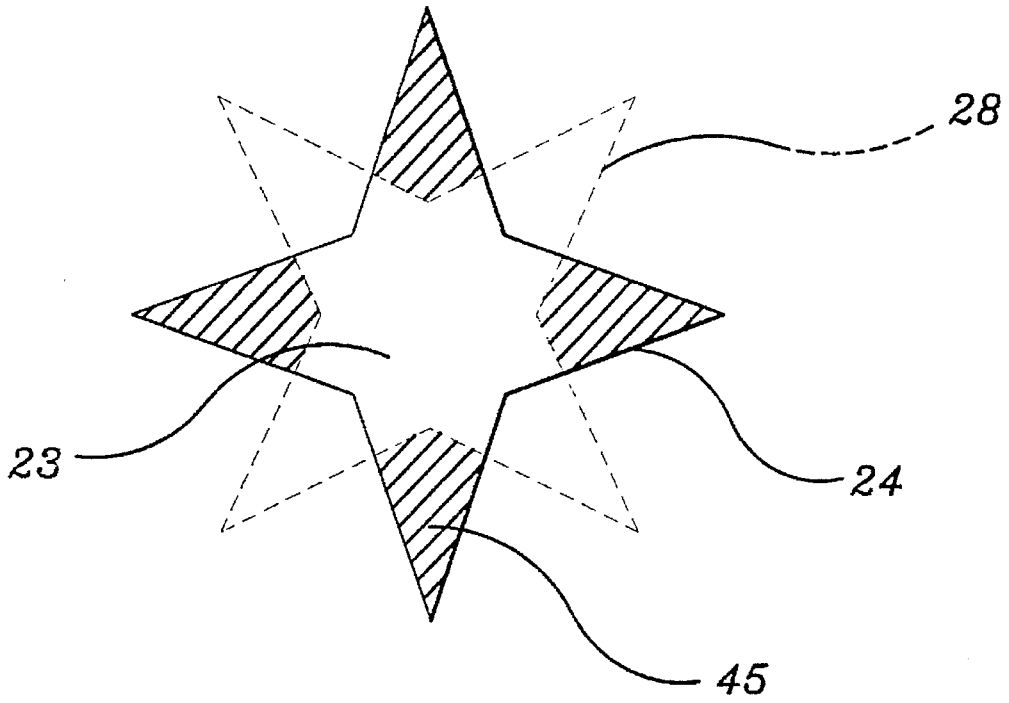
FIG. 4 is a detail of the orifice and port patterns, for a square watering pattern, rotated 45 degrees from one another, providing the smallest opening for water passage.
Figure 5:
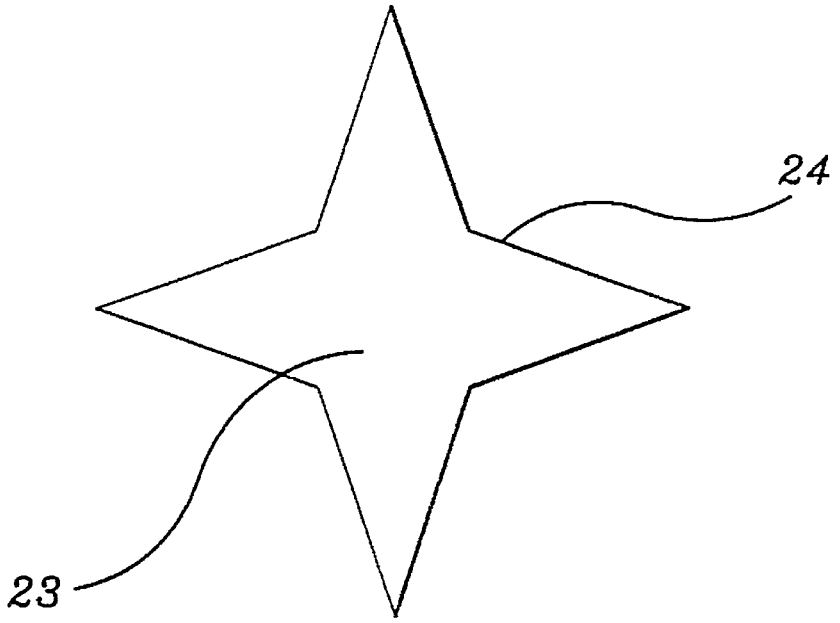
FIG. 5 is a detail of the orifice and port patterns in radial alignment providing the largest opening for water passage.

FIG. 5 shows a four point star or equilateral concaved octagon design of orifice pattern 24. The total cross-sectional area of orifice pattern 24 is equal to or greater than the cross-sectional area of nozzle 53, thereby allowing maximum flow through nozzle 53. Port pattern 28 is identical in design to orifice pattern 24. Therefore, maximum flow through orifice 23 and a port 27 occurs when orifice pattern 24 and port pattern 28 are in angular alignment (FIG. 5). Minimum flow occurs when orifice pattern 24 and port pattern 28 are rotated 45 degrees with respect to one another. FIG. 4 describes this situation. The minimum cross-sectional area of flow is approximately 50 percent of the cross-sectional area of nozzle 53. The variation in the flow passage area from a minimum to a maximum at four equispaced angular positions of orifice pattern 24 and port pattern 28, results in a square irrigation pattern.

An overlap area 45 is created by port face 29. In the fully resticted position (FIG. 4), the water flow sees a flat wall in four places (overlap area 45). This abrupt change in flow creates upward pressure against port piece 12 which is transferred to washer 14. This pressure is small due to the high velocity of the water.

As water flows through the resticted area (FIG. 4) it sees an abrupt change in cross-sectional area entering port pattern 28. This creates a tendency toward turbulent flow. Channels 32, formed between projections 32*a*, act as flow straightners and reduce this turbulent effect. Streamlined channel 33 reduces this turbulence even more. Water flows out of channel 33 and into shaft 51.

The coupling of port piece 12 with connecting ears 31 to shaft 51 generates no axial force against shaft 51. Water flows through bore 57 and into head 50 to nozzle 53 and is dispensed to the ground to be irrigated.

In a test of an impact drive sprinkler of the type shown in the embodiment of FIG. 1 having an 11/64 inch nozzle mounted to a regulator device as described herein, it was found that the following approximate maximum and minimum distances from the sprinkler and flows were attained when water at the stated pressure was supplied to the regulator device from the riser:

| | Radial Distance (ft) | | Flow (gal/min) | |
|---|---|---|---|---|
| Water pressure (p.s.i.) | min | max. | min | max |
| 30 | 23 | 30 | 3.0 | 3.7 |
| 40 | 29 | 40 | 3.2 | 4.0 |
| 50 | 32 | 45 | 3.4 | 4.5 |
| 60 | 35 | 50 | 3.7 | 5.0 |
| 70 | 38 | 52 | 4.1 | 5.5 |
| 80 | 40 | 55 | 4.1 | 6.0 |

Summary, Ramifications, and Scope

Thus, it can be seen that by use of the fluid flow regulator 10 of the present invention, a rotary sprinkler 50 can be controlled to irrigate a square surface area at a constant angular velocity with appropriate flow and distance to ensure uniform distribution. Moreover, the fluid flow regulator 10 operates in a reliable and effective manner to permit control over relatively wide limits of substantially any type rotary sprinkler device having a body adapted for rotation about an axis and an inlet through which water from a preassigned source is received and which rotates together with the body about the axis.

A variety of modifications and improvements to the invention described herein are believed to be apparent to those skilled in the art. Accordingly, no limitation on this invention is intended, except by way of the appended claims.

I claim:

1. A fluid flow regulator readily attachable between a rotary sprinkler and a fluid conduit for regulating the flow and pressure to the sprinkler, comprising:

(a) a body having a streamlined channel leading to a straight through flow orifice having a four point star design, said body being connectable with a respective fluid port member of the sprinkler and the conduit, (b) a rotatable port piece mounted in said body having a straight through flow port having a four point star design, centered on the axis of rotation and communicating with said straight through flow orifice, leading to a streamlined channel, said rotatable port piece having means for rotationally coupling to the sprinkler, (c) a retaining sleeve, mounted in said body, having an internal bore diameter to accommodate said rotatable port piece whereby said port piece is allowed to rotate, (d) a seal means between said rotatable port piece and said retaining sleeve.

2. A fluid flow regulator for attachment between a rotary sprinkler and a fluid conduit to regulate fluid flow and pressure at the sprinkler, said flow regulator comprising:

a body having an upper end and a lower end, said body including a bore extending therein from said upper end, said body including a body channel extending from said lower end and terminating at the bore in an orifice;

a port piece rotationally and removably coupled to said sprinkler, said port piece completely rotatably mounted within said bore, said port piece including a port channel therethrough in fluid communication with the body channel, the port channel originating at an port in alignment with the orifice; and retaining means disposed in said body for axially retaining said port piece within said body; whereby said port piece is rotated by the sprinkler to vary the angular alignment of the orifice and the port thus producing cyclic restriction of fluid flow through said flow regulator.

3. The fluid flow regulator according to claim 2 wherein said retaining means comprises a retaining sleeve mounted within said body around said port piece.

4. A fluid flow regulator for attachment between a rotary sprinkler and a fluid conduit to regulate fluid flow and pressure at the sprinkler, said flow regulator comprising:

a body having an upper end and a lower end, said body including a bore extending therein from said upper end, said body including a body channel extending from said lower end and terminating at the bore in an orifice, the body channel including internal longitudinally tapered body protrusions extending from said orifice, said body protrusions defining the orifice;

a port piece rotatably mounted within said bore, said port piece including a port channel therethrough in fluid communication with the body channel, the port channel originating at an port in alignment with the orifice, the port channel including internal port projections extending longitudinally from said port, said port projection defining the port; whereby rotation of said port piece varies the angular alignment of the orifice and the port thus producing cyclic restriction of fluid flow through said flow regulator.

5. The fluid flow regulator according to claim 4 wherein the orifice and the port have identical shapes.

6. The fluid flow regulator according to claim 4 wherein the orifice and the port have four point star designs.

7. The fluid flow regulator according to claim 4 wherein said body protrusions are tapered at approximately 8 degrees.

8. The fluid flow regulator according to claim 4 wherein said port piece includes coupling means for rotationally coupling said port piece to a rotary sprinkler.

9. The fluid flow regulator according to claim 8 wherein said coupling means includes connecting ears extending from said port piece.

10. The fluid flow regulator according to claim 8 further including retaining means for axially securing said port piece within said body whereby axial force of fluid flow against said port pattern is transferred to said body thus preventing transfer of axial force to the rotary sprinkler from said port piece.

11. The fluid flow regulator according to claim 10 wherein said retaining means comprises a retaining sleeve mounted within said body around said port piece.

* * * * *